US006698474B1

(12) United States Patent
Trsek

(10) Patent No.: US 6,698,474 B1
(45) Date of Patent: Mar. 2, 2004

(54) BAG HANDLING APPARATUS

(75) Inventor: William J. Trsek, 4236 W. 20th St., Cleveland, OH (US) 44109-3465

(73) Assignee: William J. Trsek, Cleveland, OH (US)

( * ) Notice: Subject to any disclaimer, the term of this patent is extended or adjusted under 35 U.S.C. 154(b) by 0 days.

(21) Appl. No.: 10/383,415

(22) Filed: Mar. 7, 2003

(51) Int. Cl.[7] ..... B65B 67/04
(52) U.S. Cl. ..... 141/315; 248/97; 141/316
(58) Field of Search ..... 248/95, 97, 99, 248/100, 101; 141/314, 315, 316

(56) References Cited

U.S. PATENT DOCUMENTS

| | | | | | |
|---|---|---|---|---|---|
| 289,181 | A | * | 11/1883 | Valentine | 248/99 |
| 575,403 | A | * | 1/1897 | Morton | 248/100 |
| 2,188,047 | A | * | 1/1940 | Jones | 248/99 |
| 3,754,785 | A | * | 8/1973 | Anderson | 294/19.1 |
| 4,445,658 | A | * | 5/1984 | Ferron | 248/99 |
| D276,786 | S | | 12/1984 | Chen | |
| 4,750,695 | A | * | 6/1988 | Greenhouse | 248/99 |
| 4,874,141 | A | * | 10/1989 | Schulz | 248/97 |
| 5,031,948 | A | | 7/1991 | Groth et al. | |
| 5,060,893 | A | | 10/1991 | Halbert | |
| 5,163,645 | A | * | 11/1992 | Caruso | 248/99 |
| 5,228,654 | A | * | 7/1993 | Carpentier | 248/99 |
| 5,353,805 | A | | 10/1994 | Mojena | |
| 5,358,295 | A | | 10/1994 | Campbell | |
| 5,639,050 | A | | 6/1997 | Peterson et al. | |
| D389,634 | S | | 1/1998 | Shope | |
| 6,076,783 | A | * | 6/2000 | Card | 248/99 |
| 6,135,518 | A | * | 10/2000 | Holthaus | 294/1.1 |
| 6,431,503 | B1 | * | 8/2002 | Horan | 248/101 |
| 2002/0032911 | A1 | * | 3/2002 | Tanaka et al. | 725/153 |

* cited by examiner

*Primary Examiner*—Ramon O. Ramirez
*Assistant Examiner*—Kofi Schulterbrandt
(74) *Attorney, Agent, or Firm*—Watts Hoffman Co., L.P.A.

(57) ABSTRACT

An apparatus for use in handling a bag. The apparatus includes a center support member, a bag tensioner mounted to the support member and a pair of spaced apart tines mounted to the tensioner and extending downwardly with respect to the tensioner. The tines have a length greater than a length of the bag sides and a width for defining an opening in a bag. The tensioner is adjustable from a bag tensioning position to a bag release position, such that in the release position the first and second tines are disposed at the bag release distance such that the tines are insertable into the open end of the bag. When a bag is mounted on the tines and the apparatus is set upon a flat surface, the support member and the tines locate the apparatus such that an opening in the bag is readily accessible for loading food.

19 Claims, 2 Drawing Sheets

BAG HANDLING APPARATUS

FIELD OF INVENTION

The present invention is directed to an apparatus for use in handling a bag, and more particularly, the invention is directed to an apparatus for holding a bag open for ease in filling the bag with food or other material.

BACKGROUND OF THE INVENTION

The use of bags to store material is common in many commercial and residential tasks. Commonly used bags are often constructed of inexpensive materials such as plastic or paper. Plastic bags are particularly popular to store food in the home and to transport food to other locations, such as to school, work or an outdoor location.

Inexpensive plastic bags typically do not include substantial structural support. As a result, the bags must be held open by the user when the bag is being filled. Such types of bags may be held open with one hand by the user, while the user's other hand is used to coordinate food into the bag. Depending on the type of food being filled, the task of filling the bag may be difficult and time consuming. Further, the process may result in a littered workspace and soiled hands for the user, each requiring additional time for the user to perform appropriate cleaning.

There is a need in the art for an apparatus that holds a bag open while material is loaded into the bag, that allows a bag to be quickly and easily mounted to and released from the apparatus, and further allows the benefit of "hands free" use for the user.

SUMMARY OF THE INVENTION

An apparatus for holding a bag open for ease in filling the bag with material. The apparatus is adapted to hold a plastic bag open while an operator fills the bag with food. The apparatus advantageously allows for "hands free" use by the operator.

In a preferred embodiment, an apparatus for use in handling a bag that has two sides, an open end and a closed end, includes a center support member, a bag tensioner mounted to the support member, and a pair of spaced apart tines mounted to the bag tensioner and extending downwardly with respect to the bag tensioner. The tines have a length greater than a length of the bag sides and a width for defining an opening in the bag open end. The bag tensioner is adjustable from a bag tensioning position to a bag release position, such that in the release position the first tine and the second tine are disposed at the bag release distance such that the tines are insertable into the open end of the bag. When the bag is mounted on the tines and the apparatus is set upon a flat surface, the support member and the tines locate the apparatus such that an opening in the open end of the bag is readily accessible for loading.

The tensioner may be a pair of parallel spaced movable arms each associated with one of the tines wherein the arms can be moved toward one another to place the tensioner in the bag release position. The arms may includes a set of ribs defining an operator engagement location. The arms may include a pinch tab extending upwardly from the arm and defining an engagable location for engagement by a finger of an operator of the apparatus.

The apparatus may be a single uniformed piece of molded plastic.

In one embodiment, when a bag is mounted on the tines and the apparatus is set upon a flat surface, the support member and the tines balance the apparatus without additional support. Further, when a bag is mounted on the tines and the apparatus is set upon a flat surface, a bottom of the support member and a bottom of each of the tines may define a plane; that is co-planar with the flat surface.

The center support member may be an elongated column having a length greater than 4.0 inches, wherein the center support member defines a handle for use by an operator of the apparatus. The center support may extend downwardly at an angle away from the tensioner and away from the tines.

The tines may have a width that decreases as the tine extends downwardly from the tensioner. Each of the tines may extend downwardly from the tensioner and terminate in an arcuate bottom portion. A distance between the tines may decrease as each of the tines extends downwardly from the tensioner.

Other objects and advantages and a fuller understanding of the invention will become apparent to others with ordinary skill in the art from the following detailed description of the preferred embodiments and accompanying drawings.

DESCRIPTION OF THE PREFERRED EMBODIMENT

Figure 1:
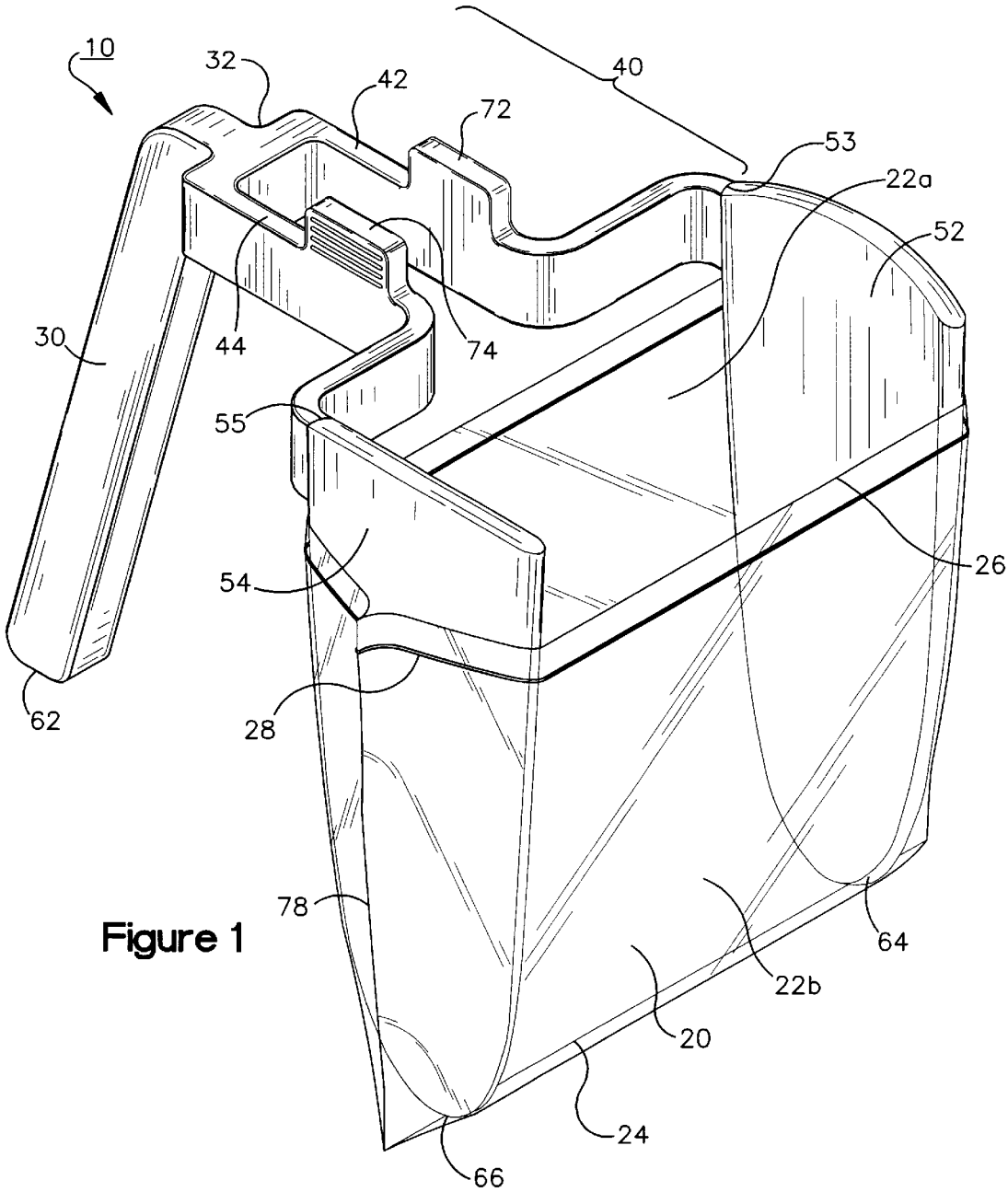
FIG. 1 is a perspective view of an apparatus constructed in accordance with the present invention, showing a plastic bag mounted on the apparatus.

Referring now to the drawings, FIG. 1 is a perspective view of an apparatus 10 constructed in accordance with the present invention. The apparatus 10 is designed and adapted to hold a bag open while a user fills the bag with food. The apparatus allows for an operator to mount a bag on the apparatus, set the apparatus and the mounted bag onto a flat surface, and with "hands free" operation of the apparatus, fill the bag with food.

As illustrated in FIG. 1, a plastic bag 20 is shown mounted on the apparatus 10. The plastic bag 20 as shown is a conventional bag, having two sides 22*a*, 22*b*, a sealed closed end 24, and an unsealed open end 26. Slightly offset from the open end 26 is a zipper 28 that allows the bag to be locked once filled with food. It should be understood by others with ordinary skill in the art that other types of bags can be used in the practice of this invention.

Figure 3:
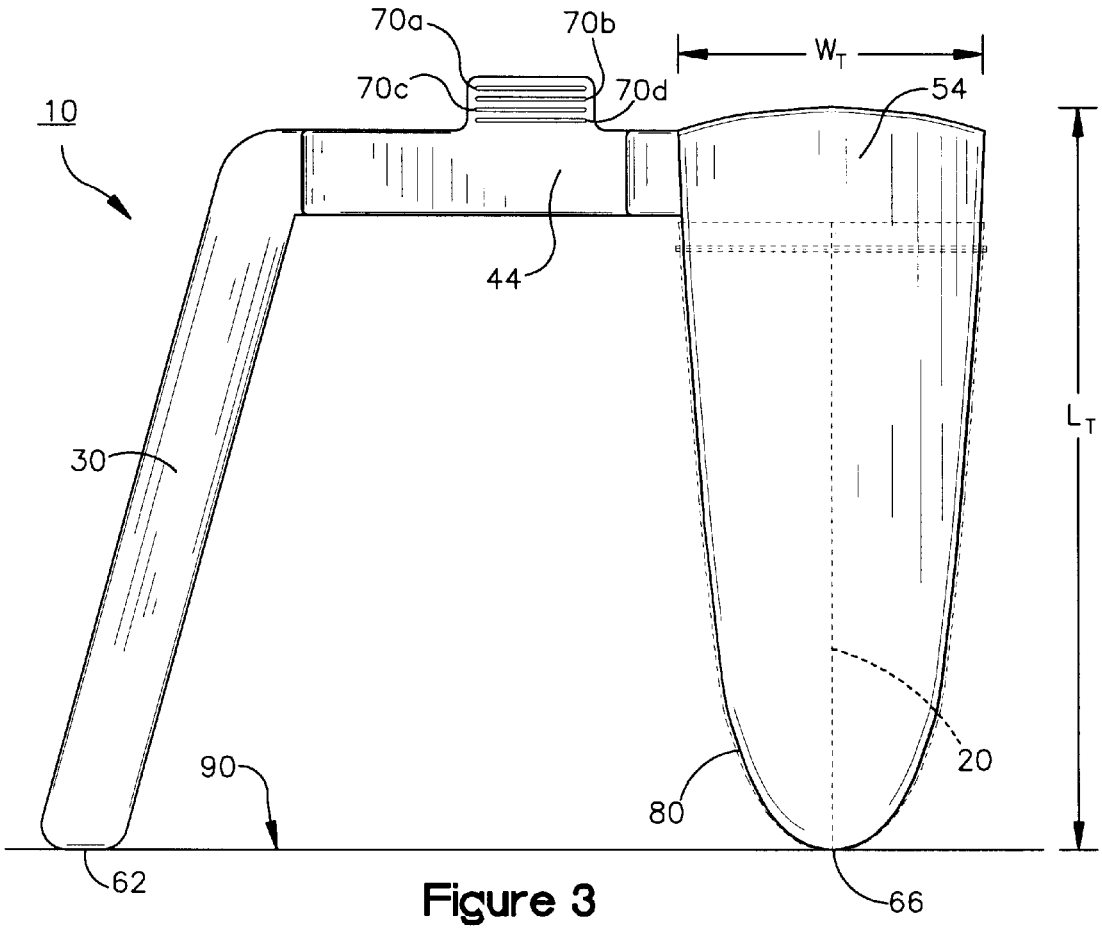
FIG. 3 is a side elevation view of the apparatus illustrated in FIG. 1.

The apparatus 10 includes a center support member 30, a bag tensioner 40 and a pair of spaced apart tines 52, 54. The bag tensioner 40 is mounted to the support member 30 at a location 32 at the upper end of the support member 30. The pair of spaced apart tines 52, 54 are mounted to the bag tensioner 40 at two location 53, 55 respectively at the distal end of the tensioner with respect to the center support member 40. The tines 52, 54 extend downwardly with respect to the bag tensioner 40. FIG. 3 is a side elevation view of the apparatus illustrated in FIG. 1. As best seen in FIG. 3, the tines 52, 54 have a length $L_T$ greater than a length of the bag sides and a width $W_T$ for defining an opening in the bag open end.

Figure 2:
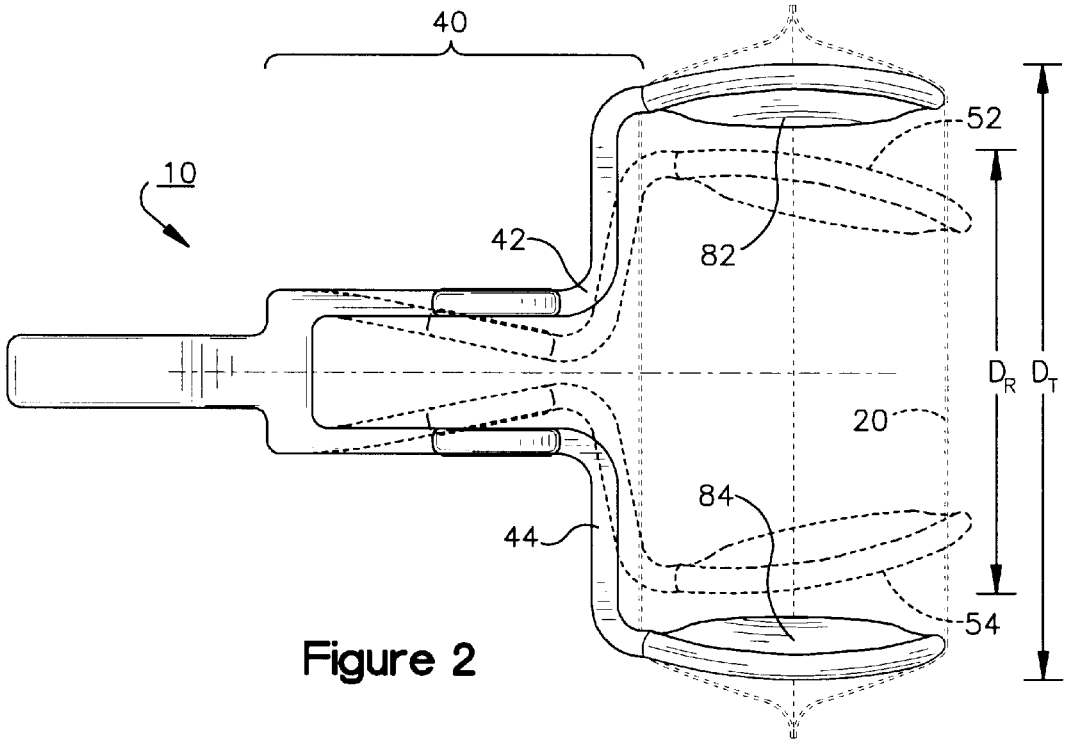
FIG. 2 is a top view of the apparatus illustrated in FIG. 1.

The apparatus as shown in FIGS. 1–3 is a single uniformed piece of molded plastic. In other words, the support member 30, tensioner 40 and tines 52, 54 are all formed together as parts of a single unit. However, it should be understood by others with ordinary skill in the art that other types of materials, connection techniques, and manufacturing methods can be used to produce an apparatus accordance with the present invention.

In the embodiment shown in FIG. 1, the tensioner 40 is formed by a pair of parallel spaced movable arms 42, 44. Each arm is associated and attached with one of the tines 52, 54 at a connection point 53, 55 respectively. As best shown in FIG. 2, the arms 42, 44 can be moved toward one another to place the tensioner in a bag release position represented by the dashed lines. FIG. 2 is a top view of the apparatus illustrated in FIG. 1.

Referring still to FIG. 2, the bag tensioner 40 is adjustable from a bag tensioning position to a bag release position. In the release position, the first tine 52 and the second tine 54 are disposed at a bag release distance $D_R$ such that the tines 52, 54 are insertable into the open end of the bag. As stated, the tines 52, 54 are represented in FIG. 2 in dashed lines in the bag release position. A bag tension distance $D_T$ is also shown in FIG. 2.

Referring again to FIG. 1, a bag 20 is shown mounted on the two tines 52, 54. In this position, the tines are separated by a bar tension distance $D_T$ as best shown in FIG. 2. When the bag 20 is mounted on the tines as illustrated in FIG. 1, and the apparatus 10 is set upon a flat surface, the support member 30 and the tines 52, 54 locate the apparatus 10 such that an opening in the open end of the bag is readily accessible for loading. The opening is defined in FIG. 1 by the open end 26 of the bag 20. In this position, the bag is tensioned and essentially will not move off the tines without the application of a material force. For example, gravity alone will not remove the bag.

Advantageously, the support member 30 and the times 52, 54 balance the apparatus 10 in this position without any additional support. In the preferred embodiment illustrated in FIG. 1, a bottom surface 62 of the support member 30, a bottom surface 64 of the first tine 52, a bottom surface 66 of the second tine 54 together define a plane that is co-planar with a flat surface. This flat surface 90 is best seen in FIG. 3. This positioning allows the apparatus to rest in a fixed location without support of the operator and at the same time hold the mounted bag in a tensioned position. This positioning advantageously allows the operator to enjoy "hands free" operation of the apparatus while filling the bag with food as the bag rests on the flat surface 90.

The pair of parallel spaced movable arms 42, 44 may includes a set of ribs defining an operator engagement location. Only one set 70*a*, 70*b*, 70*c*, 70*d* is shown in FIG. 1 and 3. In the embodiment shown, the arm also include a pinch tab 72, 74 extending upwardly from each arm 42, 44. The tabs 72, 74 define an engagable location for engagement by a finger of an operator of the apparatus.

The application of the apparatus 10 positioned in the orientation shown in FIG. 1 will now be discussed. An operator may first place the index finger of his/her left hand on the outside of the first tab 72 and the thumb of his/her left hand of the outside second tab 74. The ribs 70*a* . . . 70*d* conveniently allow the operator to engage his/her finger or thumb in the proper location. By squeezing the two tabs 72, 74 together, the tines 52, 54 are moved toward one another. After application of an adequate manual force, the distance between them will become the release distance $D_R$ shown in FIG. 2. The apparatus is designed such that the force required to move the tines is not excessive, allowing use by the elderly and children. With the tines 52, 54 separated by release distance $D_R$, the operator must use his/her right hand to place to prepare the bag for insertion of the tines. As shown in FIG. 1, the bag has been oriented such that the sealed side 78 of the bag is cooperatively aligned with the tines. After orienting the bag, the operator must slip the tines 52, 54 into the bag 20 until the bottom of each time is near or adjacent the bottom inside of the bag 20. The operator then may disengage his/her finger and thumb from the tabs 72, 74, allowing the tines to separate to a tension distance $D_T$ as shown in FIG. 2. In this position, the bag 30 is tensioned and an opening at the top of the bag is defined by the bags top edge 26.

In one embodiment, the center support member 30 is an elongated column having a length greater than 4.0 inches. With at least this length, the center support member 30 defines a convenient handle for use by an operator of the apparatus. As best seen in FIG. 3, the center support shown extends downwardly at an angle away from the tensioner 40 and away from the tines 52, 54.

The tines may be conveniently shaped for ease of use by an operator. Each of the tines 52, 54 has a width that decreases as the tine extends downwardly from the arms 42, 44. As shown in FIG. 3, the tine 54 extends downwardly from the arm 44 and terminates in an arcuate bottom portion 80. Further, the internal side walls 82, 84 of the tines 52, 54 may be conveniently shaped and contoured to ease insertion into the bag. As best seen in FIG. 2, with the bag in the tensioning position, the distance between the tines decreases as each of the tines 52, 54 extends downwardly from the tensioner 40. In other words, the internal side walls 82, 84 of each tine curve toward the opposing tine as the tines extend toward the bottom surface 64, 66 respectively.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. An apparatus for use in handling a bag that has two sides, an open end and a closed end, said apparatus comprising:

a) a center support member;

b) a bag tensioner mounted to said support member; and c) a pair of spaced apart tines mounted to said bag tensioner and extending distally from said bag tensioner, said tines having a length;

d) wherein said bag tensioner is adjustable from a bag tensioning position to a bag release position, such that in said release position said first tine and said second tine are disposed at a bag release distance;

e) wherein when a bag is mounted on said tines and said apparatus is set upon a flat surface, said support member and said tines locate said apparatus such that the open end of the bag is readily accessible for loading;

f) wherein each of said tines has a width that decreases as the tine extends distally from said tensioner.

2. The apparatus of claim 1 wherein said tensioner is a pair of parallel spaced movable arms each associated with one of said tines wherein said arms can be moved toward one another to place the tensioner in said bag release position.

3. The apparatus of claim 1 wherein said tensioner is a pair of parallel spaced movable arms each associated with one of said tines wherein said arms can be moved toward one another to place the tensioner in said bag release position, wherein each of said arms includes a set of ribs defining an operator engagement location.

4. The apparatus of claim 1 wherein said tensioner is a pair of parallel spaced movable arms each associated with one of said tines wherein said arms can be moved toward one another to place the tensioner in said bag release position, wherein each of said arms include a pinch tab extending upwardly from said arm and defining an engagable location for engagement by a finger of an operator of said apparatus.

5. The apparatus of claim 1 wherein said center support member is an elongated column having a length greater than 4.0 inches, wherein said center support member defines a handle for use by an operator of said apparatus.

6. The apparatus of claim 1 wherein said center support extends distally from said tensioner and from said tines.

7. The apparatus of claim 1 wherein a distance between said tines decreases as each of said tines extends distally from said tensioner.

8. A combination of an apparatus and a bag, said combination for use by operator to load the bag with material, said bag comprising two sides, an open end and a closed end, said apparatus comprising:

a) a center support member having a bottom surface;

b) a bag tensioner mounted to said support member; and c) a pair of spaced apart tines mounted to said bag tensioner and extending downwardly with respect to said bag tensioner toward said center support member bottom surface, said tines having a length greater than a length of the bag sides and a width for defining an opening in the bag open end;

d) wherein said bag tensioner is adjustable from a bag tensioning position to a bag release position, such that in said release position said first tine and said second tine are disposed at a bag release distance such that the tines are insertable into the open end of the bag;

e) wherein when a bag is mounted on said tines and said apparatus is set upon a flat surface, said support member and said tines locate said apparatus such that said opening in the open end of the bag is readily accessible for loading;

f) wherein each of said tines has a width that decreases as the tine extends downwardly from said tensioner.

9. The apparatus of claim 8 wherein said tensioner is a pair of parallel spaced movable arms each associated with one of said tines wherein said arms can be moved toward one another to place the tensioner in said bag release position.

10. The apparatus of claim 8 wherein said tensioner is a pair of parallel spaced movable arms each associated with one of said tines wherein said arms can be moved toward one another to place the tensioner in said bag release position, wherein each of said arms includes a set of ribs defining an operator engagement location.

11. The apparatus of claim 8 wherein said tensioner is a pair of parallel spaced movable arms each associated with one of said tines wherein said arms can be moved toward one another to place the tensioner in said bag release position, wherein each of said arms include a pinch tab extending upwardly from said arm and defining an engagable location for engagement by a finger of an operator of said apparatus.

12. The apparatus of claim 8 wherein when a bag is mounted on said tines and said apparatus is set upon a flat surface, said support member and said tines balance said apparatus without additional support.

13. The apparatus of claim 8 wherein when a bag is mounted on said tines and said apparatus is set upon a flat surface,a bottom of said support member and a bottom of each of said tines define a plane that is co-planar with said flat surface.

14. A combination of an apparatus and a bag, said combination for use by operator to load the bag with material, said bag comprising two sides, an open end and a closed end, said apparatus comprising:

a) a center support member having a bottom surface;

b) a bag tensioner mounted to said support member; and c) a pair of spaced apart tines mounted to said bag tensioner and extending downwardly with respect to said bag tensioner toward said center support member bottom surface, said tines having a length greater than a length of the bag sides and a width for defining an opening in the bag open end;

d) wherein said bag tensioner is adjustable from a bag tensioning position to a bag ease position, such that in said release position said first tine and said second tine are disposed at a bag release distance such that the tines are insertable into the open end of the bag;

e) wherein when a bag is mounted on said tines and said apparatus is set upon a flat surface, said support member and said tines locate said apparatus such that said opening in the open end of the bag is readily accessible for loading;

f) wherein a distance between said tines decreases as each of said tines extends downwardly from said tensioner.

15. The apparatus of claim 14 wherein said tensioner is a pair of parallel spaced movable arms each associated with one of said tines wherein said arms can be moved toward one another to place the tensioner in said bag release position.

16. The apparatus of claim 14 wherein said tensioner is a pair of parallel spaced movable arms each associated with one of said tines wherein said arms can be moved toward one another to place the tensioner in said bag release position, wherein each of said arms includes a set of ribs defining an operator engagement location.

17. The apparatus of claim 14 wherein said tensioner is a pair of parallel spaced movable arms each associated with one of said tines wherein said arms can be moved toward one another to place the tensioner in said bag release position, wherein each of said arms include a pinch tab extending upwardly from said arm and defining an engagable location for engagement by a finger of an operator of said apparatus.

18. The apparatus of claim 14 wherein said center support extends downwardly with respect to said bag tensioner at an angle away from said tensioner and away from said tines.

19. The apparatus of claim 14 wherein each of said tines extends distally from said tensioner and terminates in an arcuate bottom portion.

* * * * *